US006540189B2

(12) United States Patent
Hsiang

(10) Patent No.: US 6,540,189 B2
(45) Date of Patent: Apr. 1, 2003

(54) ROTATABLE HANGER

(76) Inventor: Eddie Hsiang, 10730 Weaver Ave., S. El Monte, CA (US) 91733

( * ) Notice: Subject to any disclaimer, the term of this patent is extended or adjusted under 35 U.S.C. 154(b) by 0 days.

(21) Appl. No.: 09/754,568

(22) Filed: Jan. 5, 2001

(65) Prior Publication Data

US 2002/0088913 A1 Jul. 11, 2002

(51) Int. Cl.[7] ..... A47H 1/00; A47G 29/00; B42F 13/00; A47K 1/00; E04G 3/00

(52) U.S. Cl. ..... 248/318; 248/215; 248/339; 248/340; 248/341

(58) Field of Search ..... 248/339, 340, 248/341, 215, 323, 318, 322; 47/67, 68

(56) References Cited

U.S. PATENT DOCUMENTS 4,032,102 A * 6/1977 Wolf ..... 248/318
D250,376 S * 11/1978 Schoenbrun ..... D6/113
4,159,094 A * 6/1979 Stekoll et al. ..... 248/318
4,506,475 A * 3/1985 Elliott ..... 47/67
4,561,547 A * 12/1985 Estwanik, III ..... 211/14
4,669,693 A * 6/1987 Kagan ..... 248/318
4,956,937 A * 9/1990 Haddox ..... 47/67
D353,016 S * 11/1994 Mason ..... D26/138
5,511,754 A * 4/1996 Johannsen ..... 248/311.2
5,779,210 A * 7/1998 Canson ..... 248/318
5,836,109 A * 11/1998 Kunz ..... 47/67
5,860,248 A * 1/1999 Peters ..... 47/67
D416,409 S * 11/1999 Matthews ..... D6/514
D436,840 S * 1/2001 Vogt ..... D8/373

* cited by examiner

*Primary Examiner*—Anita King
*Assistant Examiner*—Amy J. Sterling
(74) *Attorney, Agent, or Firm*—Raymond Y. Chan; David and Raymond Patent Group

(57) ABSTRACT

A rotatable hanger adapted for suspendedly hanging on a building structure, which includes a hanging means and a supporting means rotatably affixed to the hanging means, wherein the supporting means includes a top plate connected to the hanging means, a base plate for supporting an ornamental object thereon, and at least two adjustable belts connecting the top plate to the base plate, in such a manner the ornamental object is adapted to be rotatably supported on the supporting means for selectively showing a lateral view of the ornamental object.

4 Claims, 5 Drawing Sheets

ROTATABLE HANGER

BACKGROUND OF THE PRESENT INVENTION

1. Field of Invention

The present invention relates to hanger, and more particularly to a rotatably hanger especially for an ornamental object such as a flowerpot, which is capable of suspendedly hanging on a railing or other dwelling structures, for being selectively rotated to shown any and all lateral views of the ornament object.

2. Description of Related Arts

Wind, vibrations, or some other forces can easily dislodge traditional containers for plants consisting of flowerpots or other display objects for ornamental purpose. As a result, flowerpots and the like are unsuited for placement on balcony railings or other building structures. Various proposals have been made for holding and supporting flowerpots and ornamental objects upon building structures involving modifying a window box or attachment to complicated mounting devices, brackets, or holders. Significant problems with these proposals are that they may causes difficulties to accomplish that the mounting devices are hard to install, that such devices are designed to be mounted on structures having only a certain thickness, that the mounting devices may not be placed on the corner of certain building structures, that the mounting devices are permanently affixed to the structure, that the mounting devices are unaesthetically pleasing, and that the mounting devices are expensive and difficult to manufacture.

Moreover, when the flowerpot or the ornamental object is permanently affixed on the building structure, only one view of the flowerpot or the ornamental object can be shown at one position. For a plant in the flowerpot at a fixed position, only a portion of the plant can face life-sustaining sunlight. Even though a flower when supported by a flexible holder can be rotated by twisting a flexible holder, the flexible holder may not keep the balance of the flowerpot and the flower may easily fall down.

For homes and other public places such as restaurants and shops, flowerpots for indoor plants or houseplants may be placed on the floor or carpet for providing an aesthetic atmosphere and pleasant environment. However, since the plant with soil is contained in the flowerpot, a spoiled or dirty mark of the flowerpot will remain on the carpet or the floor and will become hard to eliminate. Furthermore, the flowerpot or the ornamental object or array of ornamental objects placed on a rigid stand on floor would take up floor space that can be used for better purposes, especially when a building is most likely valued by its square footage.

SUMMARY OF THE PRESENT INVENTION

A main object of the present invention is to provide a rotatable hanger wherein a base plate thereof is adapted to be selectively rotated for showing any and all lateral views of a flowerpot or an ornamental object held by the hanger.

Another object of the present invention is to provide a rotatable hanger wherein a flowerpot is adapted to be rotatably supported thereon for obtaining optimum sunlight for growth and life sustaining of a plant.

Another object of the present invention is to provide a rotatable hanger which is adapted for suspendedly hanging on a railing or other building structures such that there is no need to alter any railing or building structure in order to support the flowerpot or ornamental object. Thus, the rotatable hanger can save floor space as the flowerpot or ornamental object is hanging on the building structure.

Another object of the present invention is to provide a rotatable hanger wherein the height of the hanger can be horizontally adjusted according to the size of the flowerpot or ornamental object or in accordance with the need of a user.

Accordingly, in order to accomplish the above objects, the present invention provides a rotatable hanger adapted for suspendedly hanging on a building structure, wherein the rotatable hanger comprises a hanging means and a supporting means rotatably attached to the hanging means in such a manner that an ornamental object such as flowerpot is adapted to be securely supported on the supporting means and axially rotated 360 degrees so as to selectively show all the lateral views. The supporting means comprises a top plate rotatably connected to the hanging means, a base plate for supporting the ornamental object, and a pair of adjustable belts connecting the top plate to the base plate.

DETAILED DESCRIPTION OF THE PREFERRED EMBODIMENTS

Figure 1:
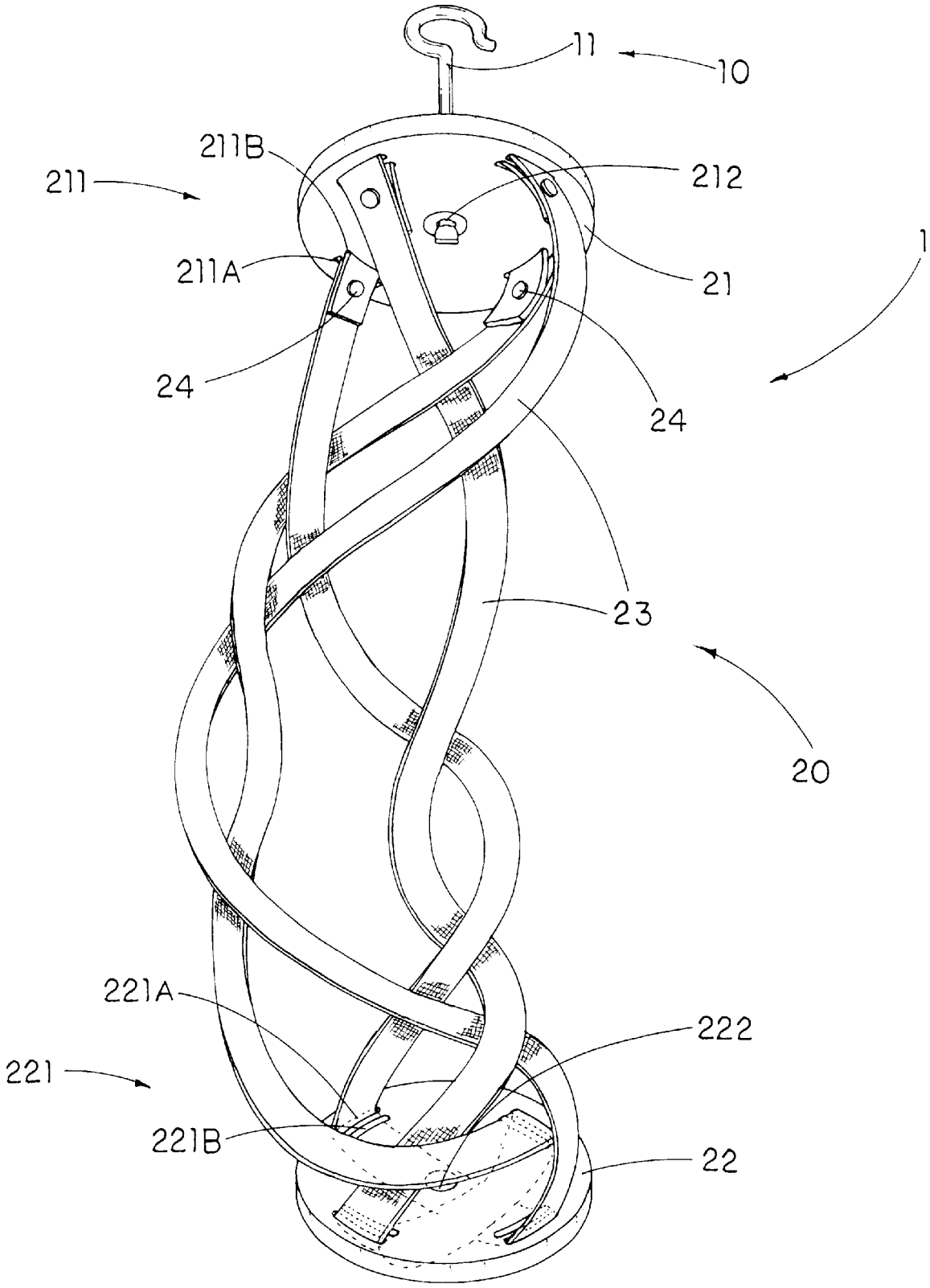
FIG. 1 is a perspective view of a rotatable hanger according to a preferred embodiment of the present invention.
Figure 3:
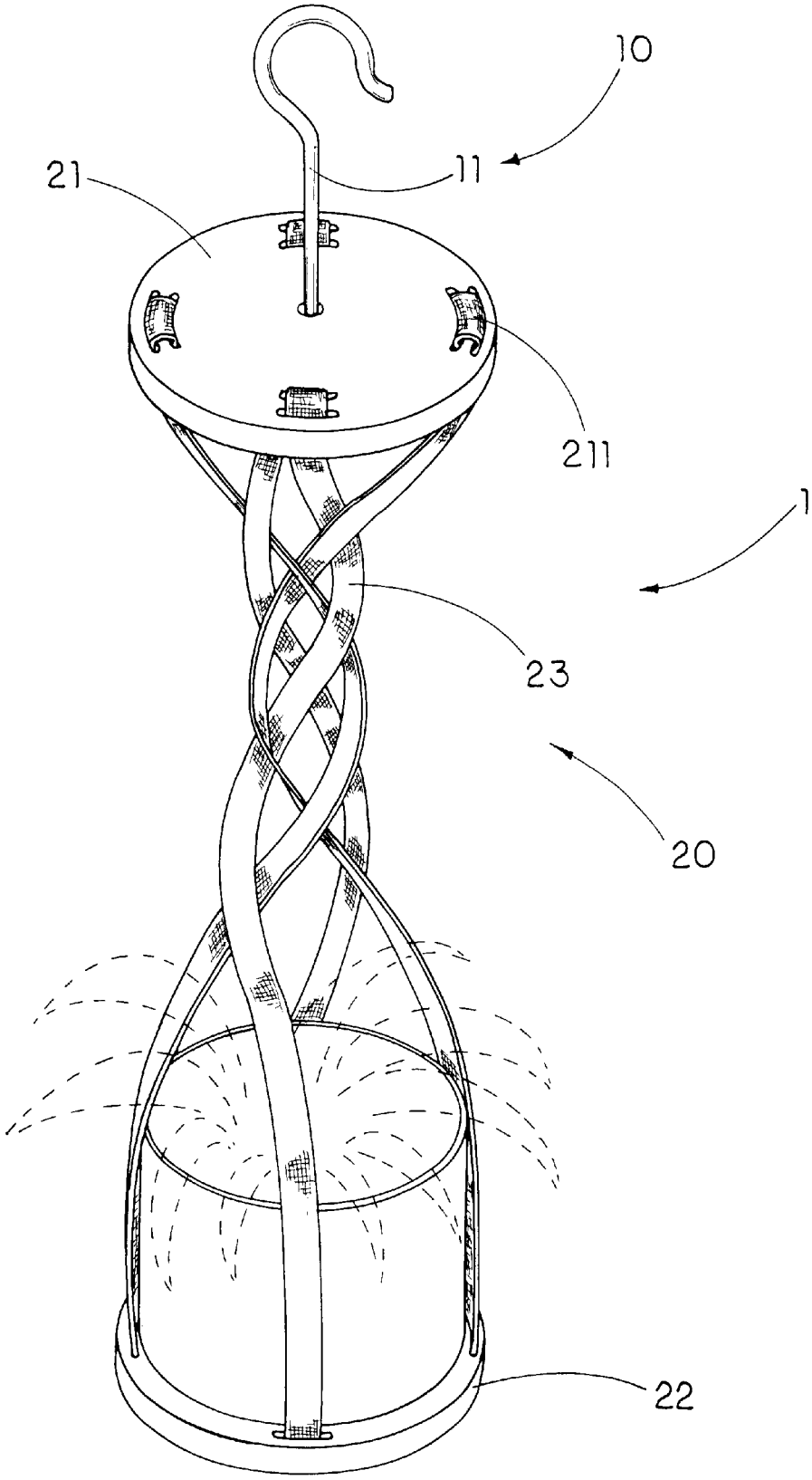
FIG. 3 is a perspective view of a flowerpot supported on the rotatable hanger according to the above preferred embodiment of present invention.

Referring to FIGS. 1 and 3 of the drawings, a rotatable hanger 1 according to a preferred embodiment of the present invention is illustrated, wherein the rotatable hanger 1 is adapted for suspendedly hanging over a ceiling, a window or other building structures. The rotatable hanger 1 is capable of rotatably supporting an ornamental object, especially a flowerpot, in such a manner that any and all lateral views of the ornamental object can be seen as the hanger rotates selectively.

As shown in FIG. 1, the rotatable hanger 1 comprises a hanging means 10 and a supporting means 20 rotatably attached to the hanging means 10 in such a manner that the ornamental object, such as flowerpot, is adapted to be securely supported on the supporting means 20 and axially rotated 360 degrees so as to be fully viewed as being rotated by the hanger 1. The supporting means 20 comprises a top plate 21 having at least two pairs of mounting slots 221 formed thereon connected to the hanging means 10, a base plate 22 having at least two pairs of supporting slots 221 formed thereon for supporting the ornament thereon, and a pair of adjustable belts 23 connecting the top plate 21 to the base plate 22.

According to the preferred embodiment, the hanging means 10 comprises a hook 11 made of durable and rustless material such as stainless steel which can strong enough for the supporting means 20 to hold the ornamental object mounted on the base plate 22. Alternatively, the hanging means 10 can be a hanging ring with a chain that can hang on a rod, bar, or other building structure.

The top plate 21 of the supporting means 20 is in circular shape, which is also made of durable and rustless material such as aluminum, wherein the hook 11 of the hanging means 10 is rotatably and perpendicularly attached on top of the plate 21 at a center mounting hole 212 formed thereon. The top plate 21 has four pairs of mounting slots 211 spacedly formed at four sides of the top plate 21, wherein each pair of the mounting slots 211 has an outer mounting slot 211A and an inner mounting slot 211B parallelly aligned near a peripheral edge of the top plate 21.

The base plate 22 preferably has a circular shape, which is also made of durable and rustless material such as aluminum, such that the ornamental object is adapted for securely being supported on the base plate 22. The base plate 22 also comprises a center supporting hole 222 perpendicularly mounted on the base plate 22 and four pairs of supporting slots 221 spacedly formed at four sides of the base plate 22, wherein each pair of the supporting slots 221 has an outer supporting slot 221A and an inner supporting slot 221B parallelly aligned near a peripheral edge of the base plate 22.

It is worth to mention that the top plate 21 and the base plate 22 has the same structural design such that during manufacturing, the top plate 21 and the base plate 22 are produced by the same mold in order to reduce the manufacturing cost of the present invention.

Figure 2:
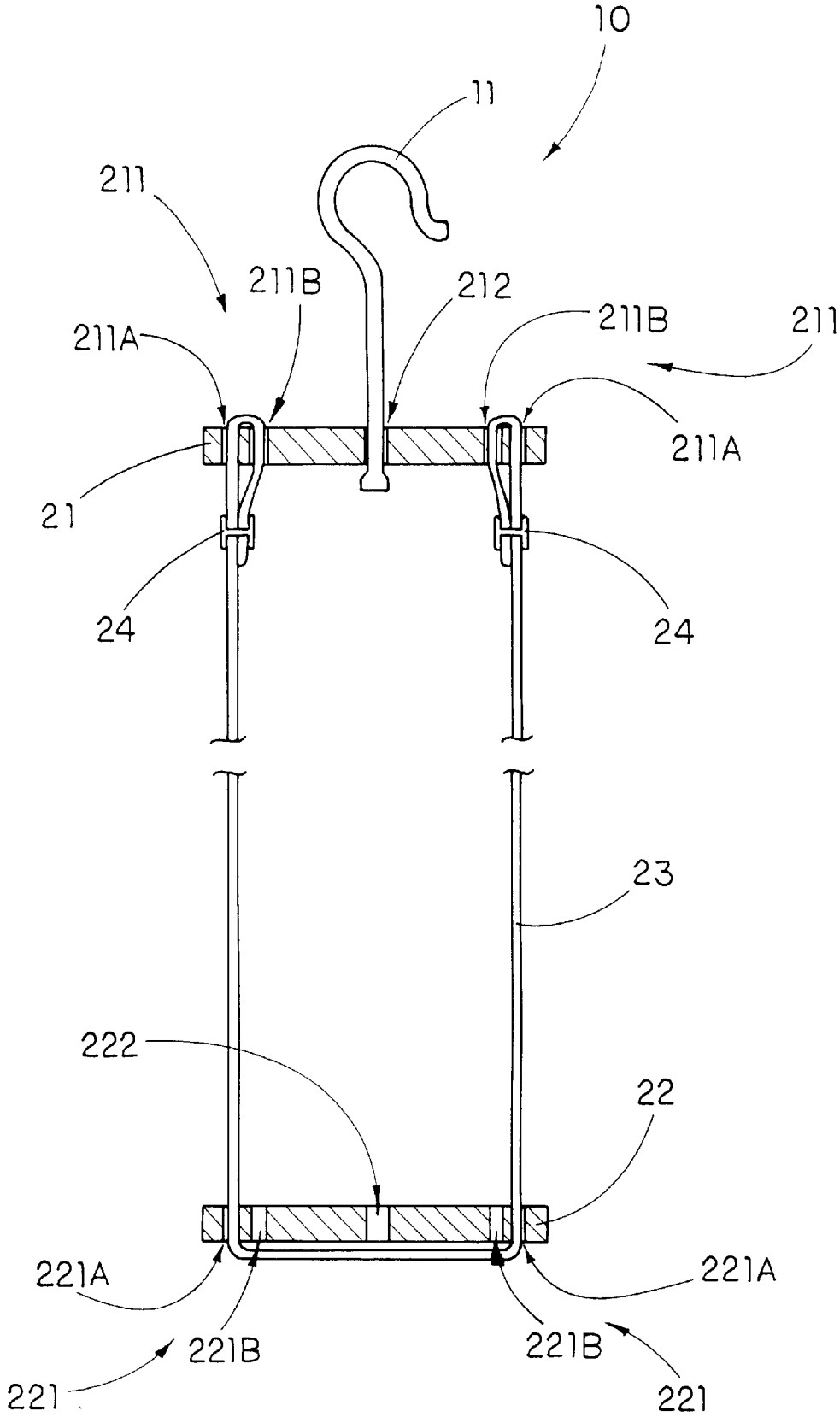
FIG. 2 is a partially sectional view of the rotatable hanger according to the above preferred embodiment of the present invention.

As shown in FIG. 2, the supporting means 20 of the rotatable hanger 1 comprises two adjustable belts 23 connecting the top plate 21 to the base plate 22 wherein each adjustable belt 23 is passing through two opposed outer mounting slots 211A and two opposed outer supporting slots 221A. The adjustable belt 23 has two overlapped ends affixedly passing two pairs of opposed mounting slots 221 respectively through the outer mounting slot 211A and the inner mounting slot 211B.

In order to firmly connect the adjustable belt 23 to the top plate 21, two rivets 24 are used to fasten the two overlapped ends of the adjustable belt 23 respectively such that the adjustable belt 23 is movable but securely mounted on the top plate 21. Each adjustable belt 23 can also adjust its length so as to selectively adjust a distance between the top plate 21 and base plate 22. Accordingly, each adjustable belt 23 is made of durable material such as nylon, which is easy to repair, such that when the adjustable belt 23 is accidentally broken, it can be easy to replace another new one.

The adjustable belts 23 are preferably twisted together in such a spiral manner that the adjustable belts 23 are intertwined each other between the top plate 21 and the base plate 22, as shown in FIG. 1. The reason of the adjustable belts 23 are spirally twisted together is that the base plate 22 will be kept in horizontally. When the adjustable belts 23 are individually connecting the top plate 21 to the base plate 22, the base plate 22 may easily slide to one side along the adjustable belts 23, such that the ornamental object supported on the base plate 22 may fall down easily. When the adjustable belts 23 are intertwined each other, the base plate 22 can be held in horizontally for the balance of the ornamental object. Thus, the adjustable belts 23 can tightly hold the ornamental object in position since the ornamental object is bundled up by the intertwining adjustable belts 23, as shown in FIG. 2.

Figure 5:
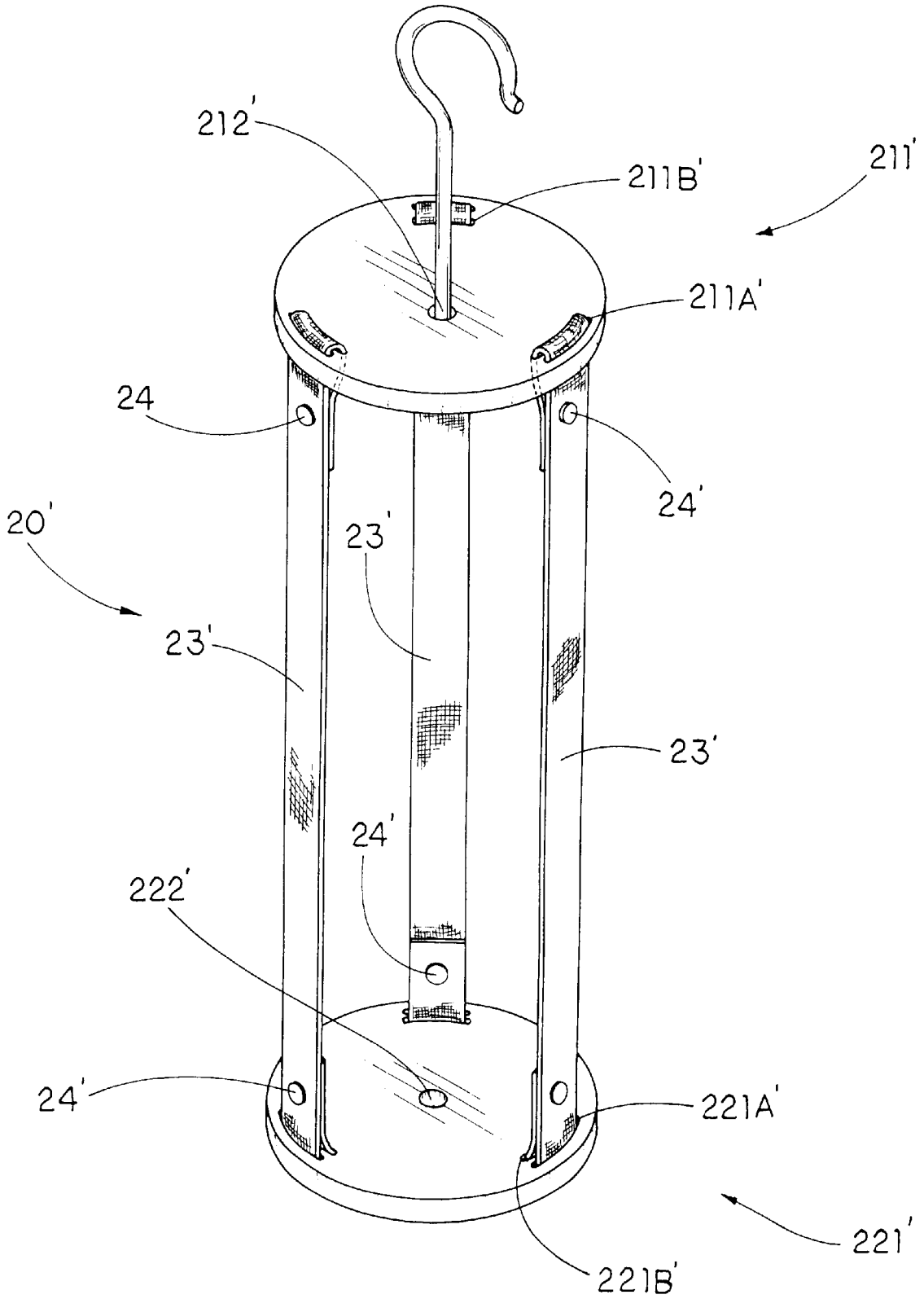
FIG. 5 illustrates an alternative mode of the rotatable hanger according to the above preferred embodiment of the present invention.

FIG. 5 illustrates an alternative mode of the rotatable hanger 1'. The top plate 21' of the supporting means 20' has a center mounting hole 212' and three pairs of mounting slots 211' spacedly formed at three sides of the top plate 21', wherein each pair of the mounting slots 211 has an outer mounting slot 211A' and an inner mounting slot 211B' parallelly aligned near a peripheral edge of the top plate 21'. The base plate 22' also has a center supporting hole 222' and three pairs of supporting slots 221' spacedly formed at three sides of the base plate 22', wherein each pair of the supporting slots 221 has an outer supporting slot 221A' and an inner supporting slot 221B' parallelly aligned near a peripheral edge of the base plate 22'.

The supporting means comprises three adjustable belts 23' connecting the top plate 21' to the base plate 22' wherein each adjustable belt 23' has an upper overlapped end affixedly passing the pair of the mounting slots 211 ' through the outer mounting slot 211A' and the inner mounting slot 211B' and a lower overlapped end affixedly passing the pair of supporting slots 221' through the outer supporting slot 221A' and the inner supporting slot 221B', so as to securely connect the top plate 21' to the base plate 22'. Two rivets 24' are used to fasten the upper overlapped end and the lower overlapped end of the adjustable belt 23' to the top plate 21' and the base plate 22' respectively to firmly mount the top plate 21 ' to the base plate 22'.

For example, when the plant in the flowerpot is supported on the rotatable hanger 1 which is hung over a window, the sunlight will shine on one side of the plant and the plant will only grow towards to the sunlight. Under such circumstances, by rotating the base plate 22 of the supporting means 20, a predetermined side of the plant can be rendered facing the sunlight as well. In other words, an user is able to selectively rotate the base plate 22 with respect to the hook 11 of the hanging means 10 in such a manner that any and all lateral views of the mounted ornamental object can face any and all directions on the same plane, and any and all lateral views of the ornamental object can be seen from one position as the hanger rotates selectively.

Furthermore, since the plant is suspendedly overhead by the rotatable hanger 1, the plant will not leave any soiled or dirty mark on the floor, and floor space can be saved.

Figure 4:
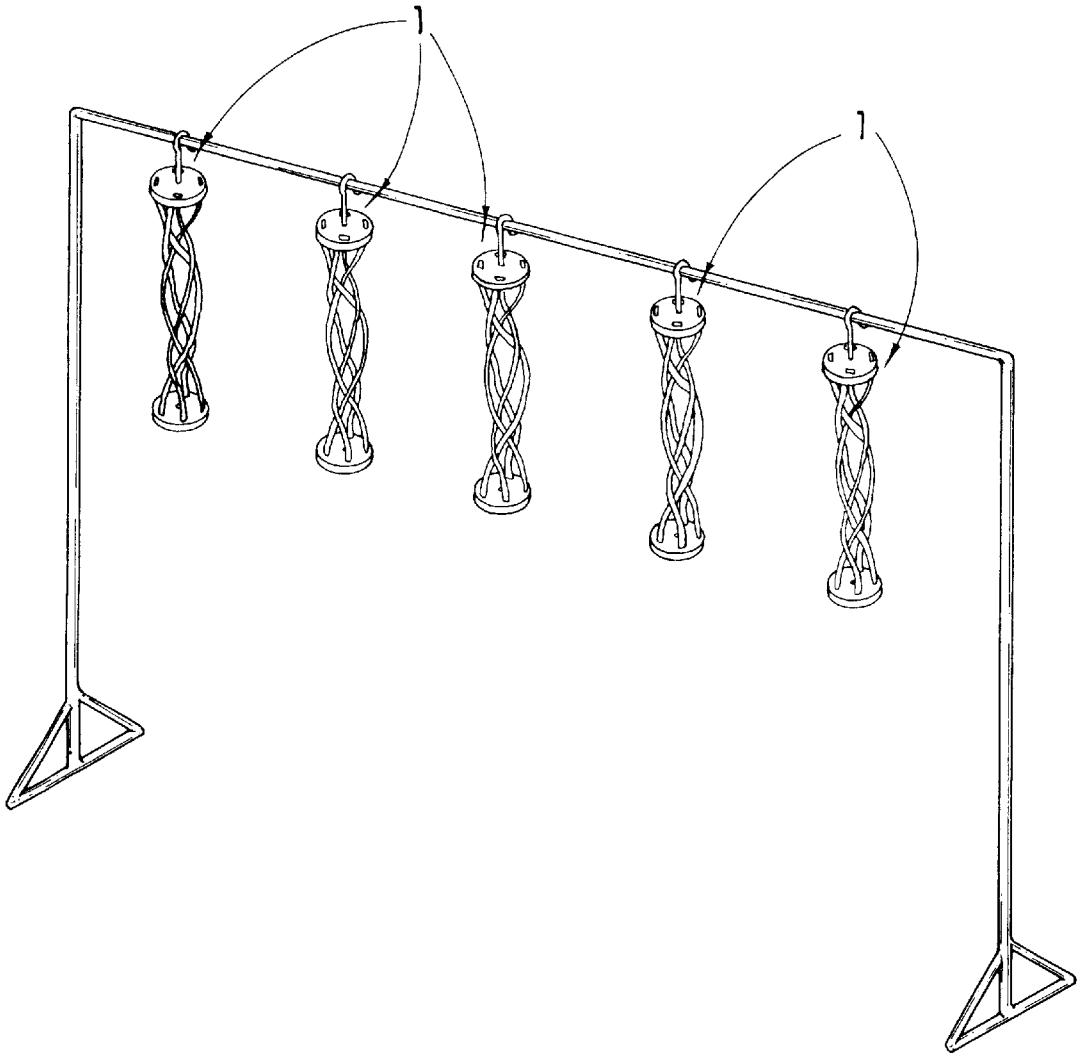
FIG. 4 is a perspective view of the rotatable hangers formed as a hanging ornament according to the above preferred embodiment of the present invention.

For further modification of the present invention, the rotatable hanger 1 is adapted to be a hanging ornament by itself, as shown in FIG. 4, wherein a plurality of rotatable hangers 1 having different heights are spacedly hung on a supporter. Thus, the rotatable hanger 1 can act as a wind chime and provide an aesthetic atmosphere.

What is claimed is:

1. A rotatable hanger adapted for suspendedly hanging on a building structure, which comprises a hanging means and a supporting means rotatably affixed to said hanging means, wherein said supporting means comprises:

a top plate having a center mounting hole formed thereon and four pairs of mounting slots spacedly formed at four opposing sides of said top plate, wherein each pair of said mounting slots has an outer mounting slot and an inner mounting slot parallely aligned near a peripheral edge of said top plate;

a base plate, which is adapted for supporting an ornamental object thereon, having a center supporting hole formed thereon and at least four pairs of supporting slots spacedly formed at four opposing sides of said base plate, wherein each pair of said supporting slots has an outer supporting slot and an inner supporting slot parallely aligned near a peripheral edge of said base plate; and two adjustable belts each having a width adapted for passing through said mounting slots and supporting slots for connecting said top plate with said base plate in such a manner that said ornamental object is adapted to be rotatably supported on said supporting means for selectively showing a lateral view of said ornamental object, wherein each of said adjustable belts has a bottom portion supported below said base plate, two hanging portions passing through said two opposing pairs of supporting slots of said base plate to extend upwards, and two overlapped ends connected to said top plate by passing said overlapped ends of said adjustable belt through said outer and inner mounting slots of said two pairs of mounting slots of said top plate respectively and affixing said two overlapped ends to two top ends of said two hanging portions respectively, wherein said adjustable belts are intertwined with each other in a spiral manner between said top plate and said base plate for holding said ornamental object in position.

2. The rotatable hanger, as recited in claim 1, wherein said hanging means comprises a hook rotatably mounted on said center mounting hole of said top plate.

3. A rotatable hanger adapted for suspendedly hanging on a building structure, which comprises a hanging means and a supporting means rotatably affixed to said hanging means, wherein said supporting means comprises:

a top plate having a center mounting hole formed thereon and at least three pairs of mounting slots spacedly formed at three opposing sides of said top plate, wherein each pair of said mounting slots has an outer mounting slot and an inner mounting slot parallely aligned near a peripheral edge of said top plate;

a base plate, which is adapted for supporting an ornamental object thereon, having a center supporting hole formed thereon and at least three pairs of supporting slots spacedly formed at three opposing sides of said base plate, wherein each pair of said supporting slots has an outer supporting slot and an inner supporting slot parallely aligned near a peripheral edge of said base plate; and at least three adjustable belts each having a width adapted for passing through said mounting slots and supporting slots for securely connecting said top plate with said base plate in such a manner that said ornamental object is adapted to be rotatably supported on said supporting means for selectively showing a lateral view of said ornamental object, wherein each of said adjustable belts has a hanging portion extended between said top plate and said base plate, an upper overlapped end connected to said top plate by passing through said outer mounting slot and said inner mounting slot of said respective pair of mounting slots and affixing to a top end of said hanging portion of said adjustable belt, and a lower overlapped end connected to said base plate by passing through said outer supporting slot and said inner supporting slot of said respective pair of supporting slots and affixing to a lower end of said hanging portion of said adjustable belt, wherein said adjustable belts are intertwined with each other in a spiral manner between said top plate and said base plate for holding said ornamental object in position.

4. The rotatable hanger, as recited in claim 3, wherein said hanging means comprises a hook rotatably mounted on said center mounting hole of said top plate.

* * * * *